United States Patent [19]

Thaler et al.

[11] Patent Number: 4,711,988

[45] Date of Patent: Dec. 8, 1987

[54] ELECTRIC HAIR DRYER WITH MULTI-MODE SWITCH FOR AIR TEMPERATURE AND FLOWRATE CONTROL

[75] Inventors: Arnold Thaler, Plantation, Fla.; P. C. Yip, Kowloon, Hong Kong

[73] Assignee: Windmere Corporation, Hialeah, Fla.

[21] Appl. No.: 782,386

[22] Filed: Oct. 1, 1985

[51] Int. Cl.[4] ..... H05B 1/02; A45D 20/00; F24H 3/04

[52] U.S. Cl. ..... 219/364; 34/97; 34/243 R; 219/370; 219/373; 219/376; 219/382

[58] Field of Search ..... 219/364, 367–370, 219/376, 380–382, 373; 34/96–101, 243 R

[56] References Cited

U.S. PATENT DOCUMENTS

| | | | |
|---|---|---|---|
| 1,454,151 | 5/1923 | Brown | 219/370 |
| 1,528,300 | 3/1925 | Nooman | 219/370 X |
| 1,607,195 | 11/1926 | Gross | 219/364 |
| 1,654,273 | 12/1927 | Shelton | 219/364 |
| 4,003,388 | 1/1977 | Nodamen | 219/370 |
| 4,019,260 | 4/1977 | Levy | 34/97 |
| 4,196,343 | 4/1980 | Ham | 219/364 |
| 4,327,278 | 4/1982 | Tomaro | 219/364 |
| 4,365,141 | 12/1982 | Weiss | 219/370 |
| 4,490,602 | 12/1984 | Ishihara | 219/368 X |

FOREIGN PATENT DOCUMENTS

| | | | |
|---|---|---|---|
| 8005531 | 5/1982 | Netherlands | 219/364 |

*Primary Examiner*—Anthony Bartis

*Attorney, Agent, or Firm*—Dickstein, Shapiro & Morin

[57] ABSTRACT

A hair dryer including a blower for selectively generating a current of air at various flow rates, a thermostatically controlled electrical heater for selectively heating the current of air at various heat generation rates and a switch mode switch and associated circuitry for selectively activating the heater and the blower and including a three position switch actuated by a single button and having a first normal mode position wherein the heater is activated to generate heat at a first heating rate and the blower is activated to generate a current of air having a first flow rate, a second cool-shot mode position wherein the heater is activated to generate heat at a second heating rate which is less than the first heat rate and the blower means is activated to generate a current of air having a second flow rate which is less than the first flow rate and a third hot-shot mode position whereupon the heater is activated to generate heat at a third heating rate which is equal to or greater than the first heat rate and the blower is activated to generate a current of air having a third flow rate which is lower than the first flow rate. A temperature switch independent of the mode switch provides additional control of the heater output level. An independent power switch is provided for concurrently controlling the heater and blower to vary the magnitudes of the heating rates and flow rates in a correlated manner in said first, second and third modes.

19 Claims, 2 Drawing Figures

ELECTRIC HAIR DRYER WITH MULTI-MODE SWITCH FOR AIR TEMPERATURE AND FLOWRATE CONTROL

BACKGROUND

The present invention relates to hair dryers and more particularly to a hair dryer having a switch for selective air temperature and flowrate control.

When hair is heated, particularly when it is wet, it relaxes and may be positioned in a variety of shapes and easily conforms thereto. For example, the hair may be wrapped around a hair curler and heated. Upon heating, the hair relaxes. When the hair cools, it sets and tends to retain the shape that it had assumed upon relaxing. Thus, when the hair curler is subsequently removed, the hair will tend to remain curled. This is particularly true if the hair is wet when hot and dry when cool.

Some known hair dryers have controls to regulate the temperature and the flow rate of the air emitted therefrom to be directed on the hair. However, in these known hair dryers, air speeds associated with hotter temperatures are typically too high. Thus, when it is desired to heat the hair positioned on the roller to relax it, some of the hair is blown away from its position around the curler. Moreover, high air speed for cooling results in a disruption of the hair from its position prior to setting of the curl.

A further disadvantage of the known hair dryers is that it is generally necesary to manipulate more than one control switch to regulate the temperature and air speeds, usually individually controlled. The operation of a plurality of switches increases the likelihood that a high air speed will be selected by mistake, thus disrupting the positioned hair.

SUMMARY OF THE INVENTION

The present invention alleviates to a great extent the disadvantages of the hair dryers of the prior art by providing a hair dryer including a blower for selectively generating a current of air at various flow rates, a heater for selectively heating the current of air at various heat generation rates and a switch for selectively activating the heater and the blower and including a three position switch having a first position wherein the heater is activated to generate heat at a first rate and the blower is activated to generate a current of air having a first flow rate, a second position wherein the heater is activated to generate heat at a second rate which is less than the first heat rate and the blower means is activated to generate a current of air having a second flow rate which is less than or equal to the first flow rate and a third position whereupon the heater is activated to generate heat at a third heating rate which is equal to or greater than the first heat rate and the blower is activated to generate a current of air having a third flow rate which is lower than the first flow rate.

It is an object of the invention to provide an improved hair dryer.

It is another object of the present invention to provide an improved hair dryer that can be easily used to quickly heat hair to relax it and then quickly cool air to set it.

It is another object of the present invention to provide an improved hair dryer with the foregoing advantages and that is less likely to disrupt the hair during the heating and cooling period.

It is a further object of the invention to provide a hair dryer having a single switch for switching the hair dryer from a hot-low speed mode to a cool-low speed mode and to a normal mode.

Other objects and advantages of the present invention will be readily apparent from the following description and drawings which illustrate a preferred embodiment of the invention.

DETAILED DESCRIPTION OF THE PREFERRED EMBODIMENT

Figure 1:
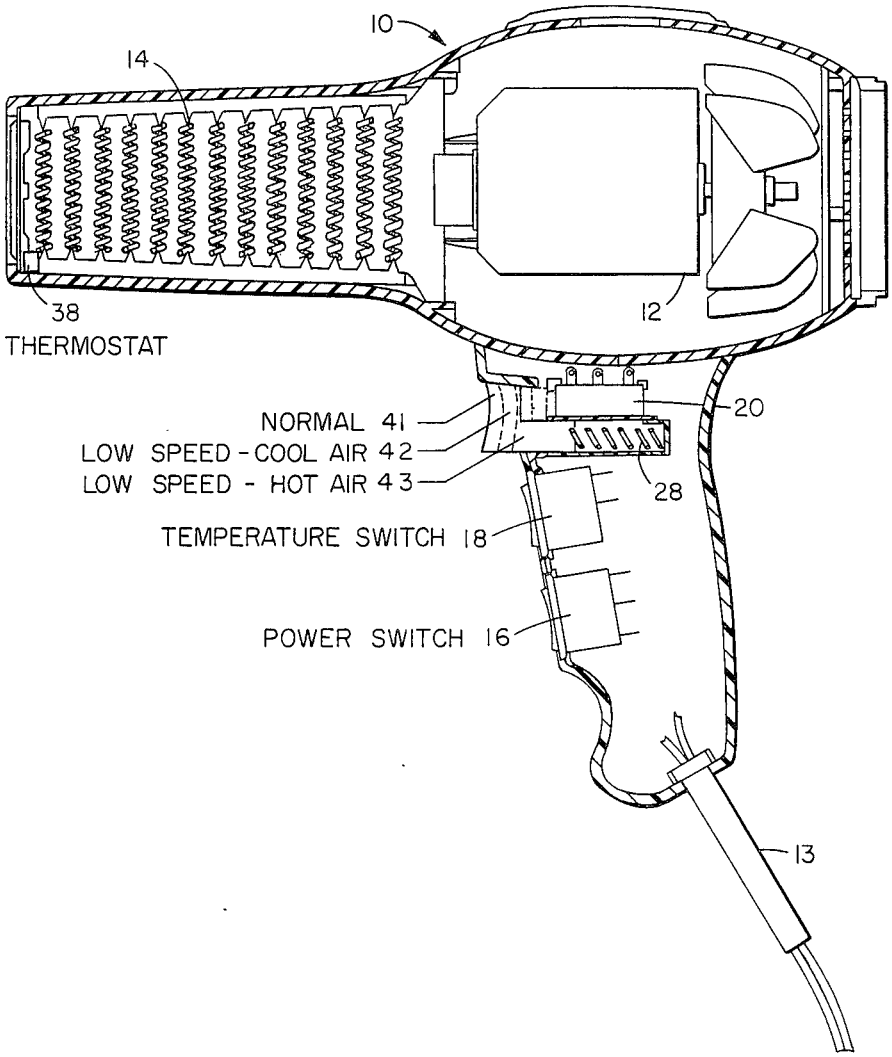
FIG. 1 is a cross-sectional elevation view of a preferred embodiment of the present invention.

Refer to FIG. 1, there being shown a cross-sectional view of a hair dryer, generally designated by reference numeral 10, according to the present invention. Hair dryer 10 includes a blower means 12 for generating a current of air through hair dryer 10. Hair dryer 10 also includes heating means 14 including a number of electric heating coils for heating the current of air generated by blower means 12.

Blower means 12 and heating means 14 are powered by electric current, such as household alternating current, supplied through cord 13. The electrical connections of the various components, associated wires and certain electronic circuit components such as resistors, capacitors, diacs, triacs, and the like are deleted from FIG. 1 for clarity. The details of the electric circuit means of the preferred embodiment are discussed below with reference to FIG. 2.

As discussed below, the control means of the hair dryer of the preferred embodiment includes power switch means 16, temperature switch means 18, mode switch means 20 and thermostat means 38.

A three position rocker switch 16, power switch means, provides control of the blower means 12 and the heater means 14. Switch 16 has a first or "low" position for low blower speed and low heater heat generation, a second or "off" position for cutting power off to both the blower and the heater, and a third or "high" position for high blower speed and high heater heat generation.

Two position rocker switch 18, temperature switch means, provides additional control of the heater means 14. Switch 18 has a first or "warm" position for a relatively low heat generation rate and a second or "hot" position for a relatively high heat generation rate.

Three position trigger switch 20, mode switch means, provides independent control of the blower means and the heater means to provide specialized operational modes for use in hair setting.

Switch 20 has a first position 41 for the first or "normal" mode wherein switches 16 and 18 control the blower means 12 and heater means 14 as described above. Switch 20 is spring biased by spring 28 to its first position 41.

Switch 20 has a second position 42 for the second or "cool shot" mode wherein heating means 14 generates heat at a reduced rate, which may be zero, and, preferably, the speed of blower means 12 is slowed.

Switch 20 has a third position 43 for the third or "hot shot" mode wherein in the preferred embodiment, heating means 14 generates at least as much heat as in the normal mode and the speed of blower means 12 is decreased with the result that the air blowing through heater means 14 is heated to a higher temperature. Alternatively, a heat generation rate lower than the normal mode could be utilized and a higher air temperature still achieved.

In operation, hair that is preferably wet is placed in a position for setting, such as around a curling roller. The hair is first subjected to air blown from hair dryer 10 with switch 20 in its third or hot shot mode position 43. Very hot air, preferably about 100° to 150° C. and more preferably about 120° C., at low blower speed is thus provided for quick heating and quick relaxation of the hair. After the hair has been sufficiently heated, switch 20 is released to the second or cool shot mode position 42 by decreasing the finger pressure on switch 20. In the cool shot mode, heater means 14 generates less heat and cool air is directed on the hair to quickly cool the hair and set its shape.

For normal hair drying, switch 20 is allowed to return to its normal or first position 41 to which it is spring biased.

Figure 2:
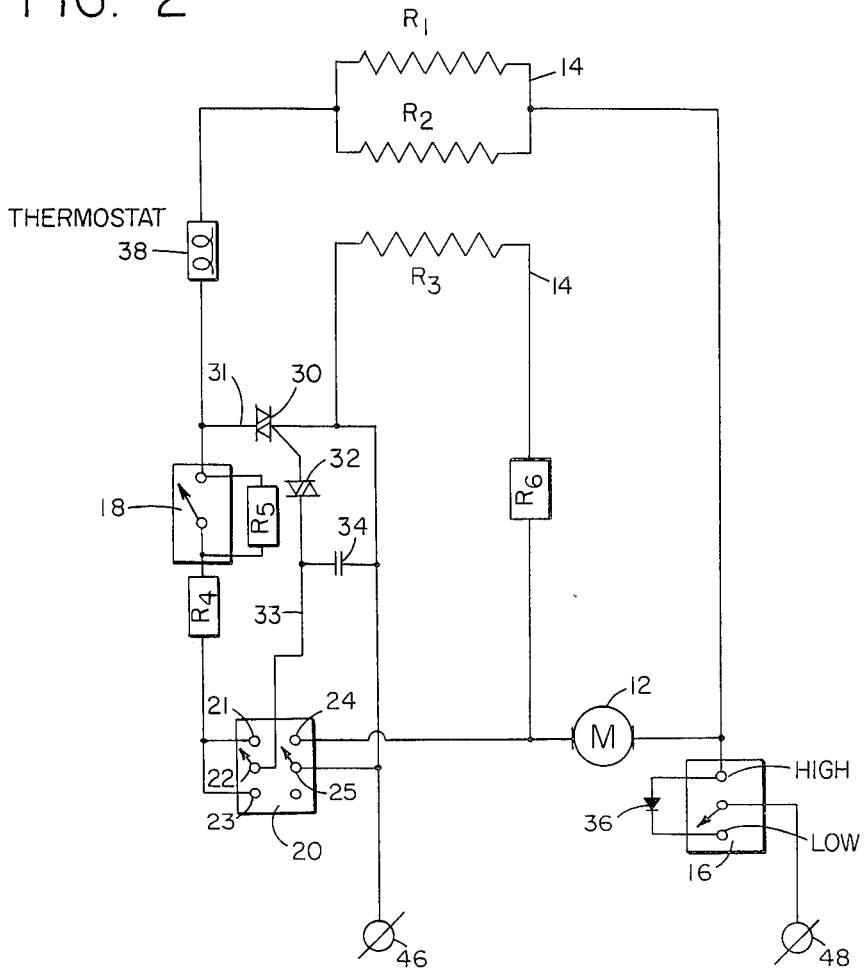
FIG. 2 is a schematic diagram of the electric circuit of the hair dryer of FIG. 1.

Refer now to FIG. 2, there being shown a circuit means diagram of the hair dryer of FIG. 1. Alternating electric current such as ordinary house current supplied via cord 13 (FIG. 1), is applied across nodes 46 and 48.

Blower means 12 includes an electric motor M, and heater means 14 includes resistance heating coil means, including heating coil reistors $R_1$, $R_2$ (primary coil means) and $R_3$ (secondary coil means), all being connected to the alternating electric current through the circuit.

Three position rocker switch 16 provides low, off and high positions. In the low position the alternating current is directed through diode 36 thereby eliminating the current flowing in one direction and effectively cutting the current flow through the circuit in half. Accordingly, with switch 16 in the low position, less electric current is flowing through the circuit and heater means 14 is generating less heat and motor M of blower means 12 is turning slower thus generating an air current having a slower speed.

When switch 16 is in the off position, an open circuit is created at switch 16 and power to heater means 14 and blower means 12 is cut off. In the off mode, power to the entire hair dryer is interrupted.

When switch 16 is in the high position, diode 36 is bypassed allowing current to flow in both directions through the circuit resulting in higher blower means motor M speed, thus a faster air current and higher heat generation of heater means 14. In the preferred embodiment, the additional heat generated in the high position is removed by the increased heat transfer of the increased air flow, so that the air temperature at the exit of the hair dryer is about the same whether power switch 16 is in the high or low position.

The electric current to heater means 14 is further controlled by two position rocker switch 18 and slide switch 20 in conjunction with the circuit formed by triac 30, diac 32 and capacitor 34. The triac 30, diac 32 and capacitor 34 are supplied in appropriate circuit form to limit the current supplied to switches 18 and 20 of the hair dryer circuit. In the circuit of FIG. 2, the current in conductor 31 is a function of the current in conductor 33. Moreover, the properties of triac 30, diac 32 and capacitor 34 are chosen so that the current through conductor 33 is substantially less than the current through conductor 31. By using the triac-diac-capacitor circuit, much of the current may be diverted from flowing through switches 20 and 18 to increase the safety of the dryer.

When temperature switch 18 is in the warm position, current is directed through resistor R5 as well as resistor R4, thereby reducing the current in conductor 33 and thereby reducing the current in conductor 31 and the current available to electric resistance heating coils $R_1$ and $R_2$ of heating means 14. When switch 18 is in the hot position, resistor R5 is bypassed thereby the current in conductor 33 increases and thus the current in conductor 31 and the current flowing to electric resistance heating coils $R_1$ and $R_2$ of heater means 14 increase, thereby increasing the heat generation rate of coils $R_1$ and $R_2$.

Thermostat 38 is present prevent damage of the hair and the hair dryer by interrupting the electric current flow if the temperature within dryer 10 reaches a predetermined level. It is advantageous to locate thermostat 38 near the exit of the hair dryer in the air stream as shown in FIG. 1.

Spring biased three positioned trigger switch 20 controls the cool shot and hot shot modes of the hair dryer. In the normal mode, corresponding to the first position 41 of the trigger switch 20, terminals 22 and 21 are connected and terminals 25 and 24 are connected. In the normal position, electric resistance heating coil $R_3$ is bypassed by the connection between terminals 24 and 25 and essentially no current flows through coil $R_3$. Electric current is supplied to coils $R_1$ and $R_2$ because terminals 21 and 22 are connected allowing current to flow in conductor 33 and thus, as explained above, in conductor 31 proportionally.

In the second position of switch 20, corresponding to the cool shot mode of the hair dryer, no terminals of switch 20 are connected. In the cool shot mode the resistance heating coils $R_1$ and $R_2$ are essentially deactivated while blower means 12 generates a current of cool air through the hair dryer. Blower means motor M operates at a lower speed in the cool shot mode than in the normal mode because the electric current to motor M must pass through resistors $R_3$ and $R_6$. If the value of $R_3$ is sufficiently high to achieve the desired decrease in motor speed, $R_6$ may not be needed. Also, heating coil $R_3$ is optional and its elimination will result in essentially no heat generation during the cool-shot mode.

In the third position of switch 20, corresponding to the hot shot mode of the hair dryer, only terminals 22 and 23 are connected. Heating coils $R_1$ and $R_2$ are activated as in the normal mode, but the blower current is supplied through heating coil resistor R3 and resistor $R_6$ thereby decreasing the blower speed. In the hot-shot mode the air becomes much hotter than in the normal mode whether the switch 18 is in the hot or warm position.

What is claimed as new and desired to be secured by Letters Patent of the United States is:

1. A hair dryer comprising: blower means for generating a current of air through the hair dryer; heater means for heating said current of air; mode switch means and associated circuitry for controlling said heater means and said blower means to operate in a plurality of modes, said mode switch means being actuated by a single button for selecting each of said modes, said plurality of modes includes a first mode wherein said heater means generates heat at a first heating rate and said blower means generates a current of air at a first flow rate, and a second mode wherein said heater means generates heat at a second heating rate lower than said first heating rate and said blower means generates a current of air having a second flow rate which is less than or equal to the first flow rate.

2. A hair dryer as in claim 1 wherein said plurality of modes includes a third mode wherein said heater means generates heat at a third heating rate which is equal to or greater than said first heating rate and said blower means generates a current of air having a third flow rate which is less than said first flow rate.

3. A hair dryer as in claim 2 wherein said second and third flow rates are less than said first flow rate.

4. A hair dryer as in claim 3 further comprising: a temperature switch means, independent of said mode switch means, for controlling the heater means for selecting heat generation rates; and a power switch means, independent of said temperature switch means and said mode switch means, for controlling the heater means and the blower means for concurrently selecting correlated air flow rates and heating rates.

5. A hair dryer as in claim 4 wherein said power switch means is for concurrently controlling the heater means and the blower means to vary the magnitudes of said first, second and third heating rates and said first, second and third flow rates in a correlated manner.

6. A hair dryer as in claim 4 wherein said power switch means varies the magnitudes of said first, second and third heating rates and said first, second and third flow rates in corresponding proportion.

7. A hair dryer as in claim 6 wherein said blower means includes electric fan means for providing said current of air and said heater means includes electric resistance heating coil means for heating said current of air, and said mode switch means, said temperature means, said power switch means, said blower means and said heater means are all interconnected by an electric circuit means for providing electric current to the blower means and the heater means.

8. A hair dryer as in claim 7 wherein said electric resistance heating coil means includes a primary heating coil means and a secondary heating coil means.

9. A hair dryer as in claim 8 wherein said primary coil means includes a first heating coil resistor and a second heating coil resistor interconnected by said associated circuitry in parallel circuit relationship.

10. A hair dryer as in claim 8 wherein said secondary heating coil means includes a third heating coil resistor in series circuit relationship with said blower means.

11. A hair dryer as in claim 11 wherein said mode switch means, only when effecting said first mode, operates in conjunction with said associated circuitry to essentially bypass said secondary coil means.

12. A hair dryer as in claim 11 wherein said mode switch means, only when effecting said second mode, operates in conjunction with said associated circuitry to essentially cut off electric current to said primary coil means.

13. A hair dryer as in claim 2 wherein said second and third flow rates are about equal.

14. A hair dryer as in claim 2 where said first and third heating rates are about equal.

15. A hair dryer as in claim 1 wherein said heating means heats the air to a first temperature for exiting the dryer in said first mode and to a second temperature in said second mode, said second temperature being lower than said first temperature.

16. A hair dryer as in claim 1 wherein said associated circuit includes a thermostat for interrupting the electric current to said heater means when the temperature of said thermostat is above a predetermined temperature.

17. A hair dryer as in claim 16 wherein said thermostat is positioned within the hair dryer proximate an air current exit thereof.

18. A hair dryer as in claim 17 wherein said button is a spring biased trigger having first, second and third positions corresponding to said first, second and third modes.

19. A hair dryer as in claim 18 wherein said mode switch means includes biasing means for biasing said button towards its first position.

* * * * *